US010850423B2

(12) United States Patent
Rautio et al.

(10) Patent No.: US 10,850,423 B2
(45) Date of Patent: Dec. 1, 2020

(54) APPARATUS AND METHOD FOR PROCESSING LOGS

(71) Applicant: VEISTO OY, Mäntyharju (FI)

(72) Inventors: Markku Rautio, Mäntyharju (FI); Tuomas Halttunen, Mäntyharju (FI)

(73) Assignee: VEISTO OY, Mäntyharju (FI)

( * ) Notice: Subject to any disclaimer, the term of this patent is extended or adjusted under 35 U.S.C. 154(b) by 147 days.

(21) Appl. No.: 15/777,361

(22) PCT Filed: Nov. 24, 2016

(86) PCT No.: PCT/FI2016/050826
§ 371 (c)(1),
(2) Date: May 18, 2018

(87) PCT Pub. No.: WO2017/089654
PCT Pub. Date: Jun. 1, 2017

(65) Prior Publication Data

US 2019/0263016 A1 Aug. 29, 2019

(30) Foreign Application Priority Data

Nov. 24, 2015 (FI) ..... 20155866

(51) Int. Cl.
*B27B 33/20* (2006.01)
*B26D 7/06* (2006.01)
(Continued)

(52) U.S. Cl.
CPC ..... *B27B 33/20* (2013.01); *B26D 7/0625* (2013.01); *B27B 7/04* (2013.01); *B27B 25/08* (2013.01); *B27L 11/007* (2013.01)

(58) Field of Classification Search
CPC ..... B27B 1/00; B27B 1/007; B27M 1/08
(Continued)

(56) References Cited

U.S. PATENT DOCUMENTS 3,934,630 A 1/1976 Cockle
4,239,069 A 12/1980 Zimmerman
(Continued)

FOREIGN PATENT DOCUMENTS

DE 29 47 190 A1 5/1981
RU 2541390 C2 2/2015

OTHER PUBLICATIONS

International Search Report (PCT/ISA/210) issued in PCT/FI2016/050826, dated Mar. 3, 2017.
(Continued)

*Primary Examiner* — Matthew Katcoff
(74) *Attorney, Agent, or Firm* — Birch, Stewart, Kolasch & Birch LLP

(57) ABSTRACT

An apparatus for processing logs includes a conveyor for conveying a log in the apparatus, a chipping canter, which comprises two chipping head assemblies for chipping the opposite sides of a log, and a saw, which comprises at least two circular blades for sawing the log on at least one side. The chipping head assemblies are installed on different shafts than the circular blades. The circular blades of a saw are situated before the chipping canter in the conveying direction of a log and are arranged to, before chipping, partly or completely saw off from the log the parts of the log that are to be chipped with the chipping head assemblies.

16 Claims, 2 Drawing Sheets

Figure 1:
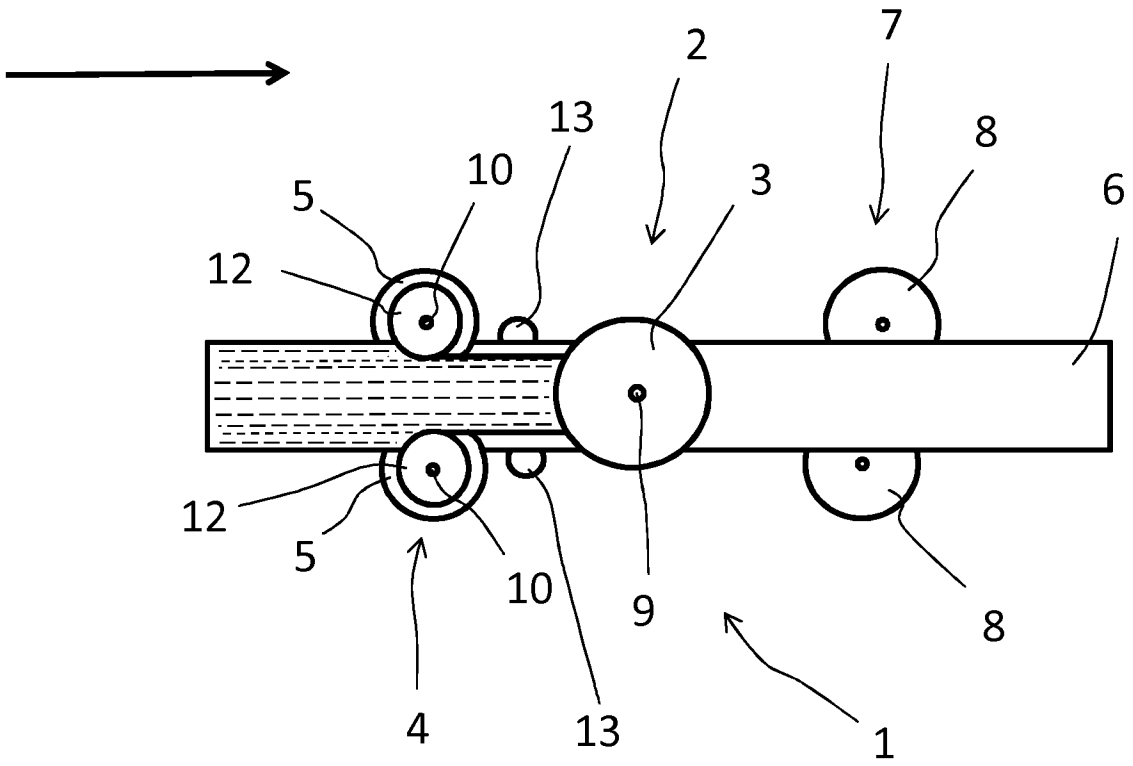

(51) Int. Cl.
*B27B 7/04* (2006.01)
*B27B 25/08* (2006.01)
*B27L 11/00* (2006.01)

(58) Field of Classification Search
USPC ..... 144/39
See application file for complete search history.

(56) References Cited

U.S. PATENT DOCUMENTS

| | | | | |
|---|---|---|---|---|
| 4,301,844 | A | 11/1981 | Tannerstål | |
| 4,711,279 | A | 12/1987 | Reuter | |
| 4,848,427 | A * | 7/1989 | Reuter | B27B 1/00 144/369 |
| 5,762,121 | A | 6/1998 | Rautio | |
| 5,915,429 | A * | 6/1999 | Pelletier | B27B 1/00 144/178 |
| 6,062,280 | A | 5/2000 | Newnes et al. | |
| 7,677,282 | B2 | 3/2010 | Stager | |
| 7,770,616 | B2 * | 8/2010 | Gross | B27B 1/007 144/39 |

OTHER PUBLICATIONS

Written Opinion (PCT/ISA/237) issued in PCT/FI2016/050826, dated Mar. 3, 2017.
Extended European Search Report, dated Jun. 26, 2019, for European Application No. 16868082.5.

* cited by examiner

APPARATUS AND METHOD FOR PROCESSING LOGS

The object of the present invention is an apparatus as defined in the preamble of claim 1 for processing logs. The object of the invention is also a method as defined in the preamble of claim 8 for processing logs.

In sawmills logs are sawn into boards with a circular saw, which comprises parallel circular blades, which are usually disposed on opposite sides of the log. Before sawing, the log is fed into a chipping canter, which comprises rotating chipping head assemblies, with which the opposite sides of the log are leveled and the wooden material being separated from the log is chipped. A chipping head assembly has chipper knives, which are fastened at a distance from each other to the body of the chipping head assembly to form a ring. A chipping head assembly generally also comprises a head saw blade, with which the surface of the log is leveled. The diameter of the head saw blade can be larger than the ring formed by the chipper knives so that, before chipping, the head saw blade saws off the part to be chipped. If the diameter of the head saw blade is smaller than the ring formed by the chipper knives, the chipper knife levels the surface of the log after chipping.

The chipping head assemblies of a chipping canter might tear off a corner of the surface being chipped, in which case an indentation is made in the log, which adversely affects the quality of the boards being sawn from the log. More particularly, an indentation can occur at a point where the contact between the chipper knife/head saw blade and the log ends during rotation of the chipping head assembly. Also a low number of teeth and low speed of rotation of the head saw blade of a chipping head assembly often result in poor surface quality of a sawn surface.

The aim of the present invention is to achieve an improved sawing arrangement and sawing method, with which the aforementioned problems can be reduced.

The aim of the invention is achieved with an apparatus according to claim 1 and with a method according to claim 8.

The apparatus according to the invention for processing logs comprises conveying means for conveying a log in the apparatus, a chipping canter, which comprises two chipping head assemblies for chipping the opposite sides of the log, and a sawing unit, which comprises at least two circular blades for sawing the log on at least one side. The chipping head assemblies are installed on different shafts than the circular blades. In addition, the circular blades of the sawing unit are situated before the chipping canter in the conveying direction of the log and are arranged to, before chipping, partly or completely saw off from the log the parts of the log that are to be chipped with the chipping head assemblies.

In the method according to the invention for processing logs a log is fed into the processing apparatus and the log is conveyed onwards in the processing apparatus, which comprises a chipping canter, which comprises at least two chipping head assemblies, with which the opposite sides of the log are chipped. The processing apparatus also comprises a sawing unit, which comprises at least two circular blades, with which the log is sawn on at least one side. The chipping head assemblies are rotated on different shafts than the circular blades. The parts of a log that are to be chipped are partly or completely sawn off from the log with the circular blades of the sawing unit before chipping.

By means of the invention significant advantages are achieved.

Because the partial or complete sawing off from the log of the parts of the log that are to be chipped takes place before the chipping canter, there are fewer indentations in the log caused by the chipping head assemblies of the chipping canter. In addition, the sawing off of the portion to be chipped reduces the amount of wooden material to be sawn off the log with the head saw blade of the chipping canter. Therefore, a head saw blade with smaller teeth can be used in the chipping head assembly, and the number of teeth in the head saw blade can be increased, in which case the surface quality of the surface sawn with the head saw blade can be improved.

If the part of the log to be chipped is partly sawn off before chipping, the part that is to be chipped and is still attached to the log is thinner in the thickness direction of the log. In this case the cutting-tool angle of the chipper knives, and the angle of incidence of the chipper knives and the log, remain within a small fluctuation range on the part that is to be chipped and is still attached, which improves the chip quality and the surface quality of the leveled side of a log. Since the circular blades of a sawing unit are installed on a different shaft/on different shafts than the chipping head assemblies, the circular blades can be rotated at a different speed of rotation than the chipping head assemblies. By rotating the circular blades at a faster speed of rotation than the chipping head assemblies, the surface quality of the sides of the log that are being leveled can be improved. The apparatus according to the invention is also easily installable in existing sawmills.

Figure 2:
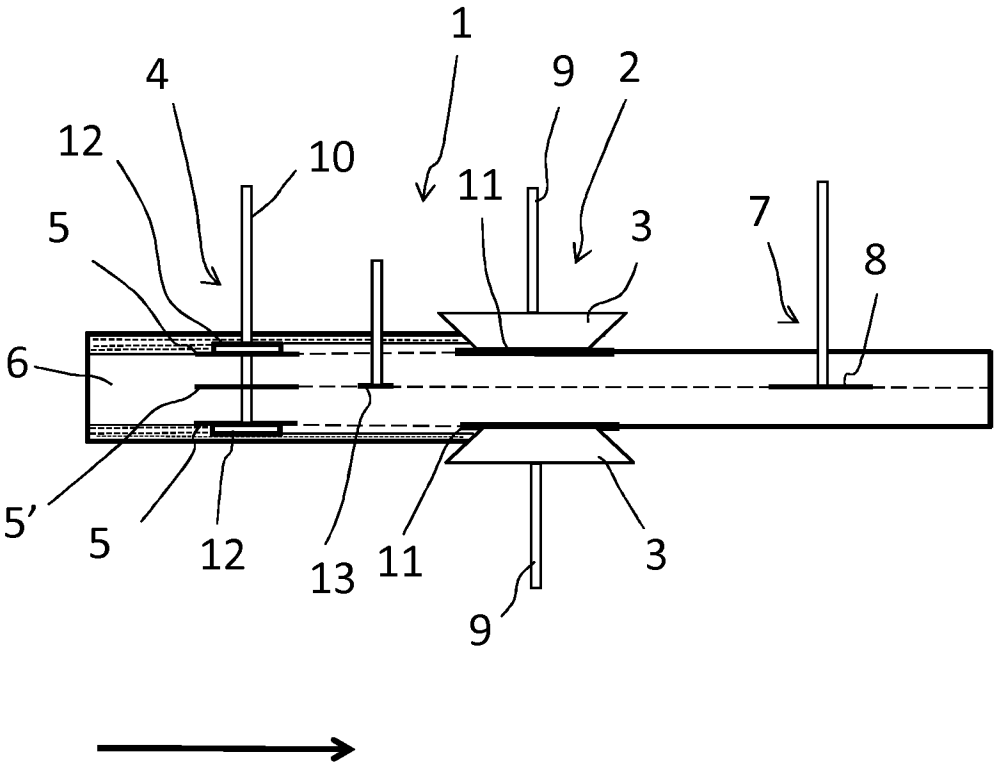

In the following, the invention will be described in more detail by the aid of some embodiments of it with reference to the attached drawings, wherein FIG. 1 presents a diagrammatic top view of an apparatus according to one embodiment of the invention, and FIG. 2 presents the apparatus of FIG. 1 as viewed from the side.

The drawings present an apparatus 1 for processing logs 6, the apparatus comprising conveying means, e.g. one or more conveyors, for conveying a log 6 in the longitudinal direction in the apparatus. The feeder means can comprise feeder wheels and draw-in rollers arranged on opposite sides of the log, the wheels and rollers conveying the log onwards in the apparatus 1. The conveying direction of the log 6 is marked in the drawings with an arrow. The apparatus 1 comprises a chipping canter 2, which comprises two chipping head assemblies 3 for leveling the opposite sides of a log 6 by chipping. The chipping head assemblies 3 are arranged on opposite sides of the route of the log 6. A chipping head assembly 3 has chipper knives, which are fastened at a distance from each other to the body of the chipping head assembly 3 to form a ring. The chipping head assemblies 3 are provided with head saw blades 11, with which the surface of a log 6 is leveled. The head saw blade 11 is on the end of the chipper knife 3 facing the log 6. The diameter of a head saw blade 11 can be greater or smaller than the ring formed by the chipper knives. If the diameter of the head saw blade 11 is larger than the ring formed by the chipper knives, before the chipping the head saw blade 11 saws off from the log 6 the part to be chipped. If the diameter of the head saw blade 11 is smaller than the ring formed by the chipper knives, the head saw blade 11 levels the surface of the log 6 after chipping. The chipping head assembly 3 and the head saw blade 11 associated with it are installed on the same shaft 9.

The apparatus 1 also comprises a sawing unit 4 for sawing a log 6. The sawing unit 4 comprises at least two circular blades 5, for sawing the log 6 in the longitudinal direction.

The chipping head assemblies 3 of the chipping canter 2 are installed on different shafts than the circular blades 5 of the sawing unit 4. The shafts of the chipping head assemblies 3 are marked in the drawings with the reference number 9 and the shafts of the circular blades 5 with the reference number 10. The shafts 9, 10 and the chipping head assemblies 3 and circular blades 5 installed on them are rotated with drive devices connected to the shafts. The circular blades 5 of a sawing unit 4 are situated before the chipping head assemblies 3 of the chipping canter 2 in the conveying direction of a log 6.

The circular blades 5 are arranged to, before chipping, partly or completely saw off from the log 6 with the chipping head assemblies 3 the parts of the log 6 that are to be chipped. If the circular blades 5 saw the parts of the log that are to be chipped completely off the log 6, the log 6 is sawn through with the circular blades 5. If the parts of the log that are to be chipped are only partly sawn off from the log 6, the circular blades 5 saw to the desired depth in the log 6. In such a case the sawing depth is smaller than the diameter of the log 6 at the point of sawing. The parts to be chipped can be partly or completely sawn off from the log 6 with the circular blades 5 on only one side of the log, in which case the sawing unit 4 has circular blades 5 on only one side of the route of the log 6. In such a case the circular blades 5 are disposed on that side of the log 6 on which contact between the chipper knife or head saw blade 11 and the log 6 ends during rotation of the chipping head assembly 3. Alternatively, the parts to be chipped can be partly or completely sawn off from the log 6 with the circular blades 5 on opposite sides of the log, in which case the sawing unit 4 has circular blades 5 on opposite sides of the route of the log 6. The circular blades 5 are situated at the same point in the width direction of the log 6 as the inner ends of the chipping head assemblies 3, i.e. the ends facing the center part of the log 6. In this case the circular blades 5 saw the log 6 at the points of the edges of the parts to be chipped. In the embodiment according to the drawings the circular blades 5 of a sawing unit 4 are situated on opposite sides of the route of the log 6, in which case the circular blades 5 partly or completely saw off the parts to be chipped from the log 6 on opposite sides.

According to one embodiment of the invention the sawing unit 4 comprises two circular blades 5 at least one inner circular blade 5' arranged between the circular blades 5, for sawing the log between the sawing points of the circular blades 5. The circular blades 5 and the inner circular blade 5' are installed on the same shaft 10. The circular blades 5 are arranged to, before chipping, partly or completely saw off from the log 6 the parts to be chipped. The circular blades 5 can be arranged to saw a log 6 on only one side or on opposite sides. Correspondingly, the inner circular blade 5' or inner circular blades can be arranged to saw a log 6 on only one side or on opposite sides. If the log 6 is sawn with the inner circular blades 5' on opposite sides of the log 6, the sawing occurs at the same points in the width direction of the log 6. With the inner circular blades 5' the log 6 is sawn to the desired depth, which is smaller than the diameter of the log 6 at the point of sawing. The circular blades 5 and/or the inner circular blades 5' on the same side of the route of the log 6 are installed on the same shaft 10.

There can also be profiling blades 12, e.g. chipping edgers, on the same shaft 10 as the circular blades 5, with which profiling blades the log 6 is milled next to the circular blades 5. The profiling blades 12 are arranged against the circular blades 5, either outside or inside the circular blades 5. In the embodiment according to the drawings the profiling blades 12 are outside the circular blades 5. With the profiling blades 12, the side boards to be sawn off from the log 6 at a later stage can be beveled.

The apparatus 1 can also comprise a second sawing unit 7, which is situated at a point after the sawing unit 4 in the conveying direction of a log 6. The second sawing unit 7 can be, in the conveying direction of the log 6, between the sawing unit 4 and the chipping canter 2 or at a point downstream of the chipping canter 2, as in the embodiment according to the drawings. If the second sawing unit 7 is situated at a point downstream of the chipping canter 2, the second sawing unit 7 comprises one or more circular blades 8 for deepening sawing grooves brought about by the inner circular blade or by the inner circular blades 5' of the sawing unit 4. In this case the second sawing unit 7 typically has as many circular blades 8 as there are inner circular blades 5' in the sawing unit 4. The circular blades 8 of the second sawing unit 7 are arranged in the same points in the width direction of the log 6 as the inner circular blades 5' of the sawing unit 4. The circular blades 8 of the second sawing unit 7 can saw through the log 6 if the second sawing unit 7 is situated at a point downstream of the chipping canter 2 in the conveying direction of the log 6. If the second sawing unit 7 is situated between the sawing unit 4 and the chipping canter 2, the second sawing unit 7 can additionally comprise circular blades, with which the sawing grooves brought about by the circular blades 5 of the sawing unit 4 are deepened. The chipping head assemblies 3 of the chipping canter 2 are installed on different shafts than the circular blades 8 of the second sawing unit 7. The sawing grooves brought about by the circular blades 5, 5' are marked with dashed lines in FIG. 2.

The apparatus 1 also comprises one or more guides 13 for guiding and supporting a log 6. The guide 13 can be a so-called riving knife, which comprises a toothless disc, that can be rotated or which is non-rotating. The guide 13 is disposed in the apparatus 1 at a point between the sawing unit 4 and the chipping canter 2 or at a point between the chipping canter 2 and the second sawing unit 7. The guide 13 is in the sawing groove brought about by the circular blade 5 or by the inner circular blade 5', in which case the guide 13 supports the log 6 from the sawing groove. If there are circular blades 5, 5' on both sides of a log 6, as in the embodiment according to the drawings, there can be a guide 13 on both sides of the log 6. Alternatively, or additionally, the log 6 can be guided and supported with a guide 13 from the surface machined by the profiling blade 12.

According to the drawings, the apparatus 1 functions in the following manner. A log 6 is fed into the processing apparatus 1 and is conveyed onwards in the processing apparatus 1 in the longitudinal direction. The parts to be chipped with the chipping canter 2 are, before chipping, partly or completely sawn off from the log 6 with the circular blades 5 of the sawing unit 4. At the same time the log 6 is milled with the profiling blades 12 that are against the circular blades 5. The parts to be chipped are sawn off from the log 6 on only one side of the log or on opposite sides of the log 6. After this the parts of the log 6 that are to be chipped are chipped with the rotating chipping head assemblies 3 of the chipping canter 2. The chipping head assemblies 3 of the chipping canter 2 are rotated on different shafts than the circular blades 5 of the sawing unit 4. If the chipping head assemblies 3 are provided with head saw blades 11, the parts to be chipped are, before chipping, sawn off from the log 6 with the head saw blades or the chipped surfaces are leveled with the head saw blades 11. The circular blades 5 are rotated at a faster rotation speed than the chipping head assemblies 3.

According to one embodiment of the invention the sawing unit 4 comprises at least one inner circular blade 5' arranged between the circular blades 5, with which inner circular blade the log 6 is sawn between the sawing points of the circular blades 5. A log 6 can be sawn with the inner circular blade or inner circular blades 5' on only one side or on opposite sides. When sawing on opposite sides, the log 6 is sawn at the same points in the width direction of the log 6.

The log 6 is guided and supported during the conveying with a guide 13 fitted into the sawing groove of the circular blade 5 or of the inner circular blade 5' and/or with a guide 13 supported on the surface machined by the profiling blade 12.

If the apparatus 1 comprises a second sawing unit 7, the sawing grooves brought about by the inner circular blade or inner circular blades 5' of the sawing unit 4 are deepened with the circular blades 8 of the second sawing unit 7, if the second sawing unit 7 is situated at a point downstream of the chipping canter 2 in the conveying direction of the log 6. The circular blades 8 of the second sawing unit 7 can saw through the log 6. If the second sawing unit is situated between the sawing unit 4 and the chipping canter 2, the sawing grooves brought about by the circular blades 5 of the sawing unit can also be deepened with the circular blades of the second sawing unit 7.

The apparatus 1 can additionally comprise one or more additional sawing units (not presented in the drawings), which comprise(s) a circular blade or circular blades, with which the sawing grooves brought about by the circular blade or circular blades of the preceding sawing unit in the conveying direction of the log 6 are deepened or with which the log 6 is sawn through.

It is obvious to the person skilled in the art that the invention is not limited solely to the embodiments presented above, but that it can be varied within the scope of the claims presented below.

The invention claimed is:

1. An apparatus for processing logs, which apparatus comprises:

a conveyor for conveying a log in the apparatus, a chipping canter, which comprises two chipping head assemblies for chipping the opposite sides of the log, and a saw, which comprises at least two circular blades for sawing the log on at least one side, the circular blades of the saw being situated before the chipping canter in the conveying direction of the log, wherein the chipping head assemblies are installed on different shafts than the circular blades, and the circular blades are situated at the same point in a width direction of the log as inner ends, facing a center part of the log, of the chipping head assemblies, and wherein the circular blades of the saw are arranged to, before chipping, partly saw off from the log the parts of the log that are to be chipped with the chipping head assemblies, and the chipping head assemblies are provided with head saw blades for, before chipping, sawing off the parts to be chipped from the log, wherein the saw comprises at least one inner circular blade arranged between the circular blades for sawing the log between the sawing points of the circular blades.

2. The apparatus according to claim 1, wherein the saw is a first saw, and wherein by a second, which is situated after the first saw in the conveying direction of a log and which comprises at least one circular blade for deepening a sawing groove brought about by the inner circular blade of the first saw or the sawing grooves brought about by the circular blades of the first saw.

3. The apparatus according to claim 1, wherein the circular blades of the saw are arranged to saw off from the log the parts to be chipped on only one side of the log or on opposite sides of the log.

4. The apparatus according to claim 1, wherein the inner circular blade or inner circular blades of the saw is/are arranged to saw a log on only one side or on opposite sides.

5. The apparatus according to claim 1, wherein profiling blades are arranged against the circular blades for milling a log.

6. The apparatus according to claim 1, wherein a guide for guiding and supporting a log during the conveying is arranged in a sawing groove of the circular blade or of an inner circular blade, or is supported on a surface machined by a profiling blade.

7. A method for processing logs, comprising the steps of:

feeding a log into a processing apparatus; and conveying the log onwards in the processing apparatus, wherein the processing apparatus comprises:

a chipping canter, which comprises at least two chipping head assemblies, with which the opposite sides of the log are chipped, and a saw, which comprises at least two circular blades, with which the log is sawn on at least one side, wherein the chipping head assemblies are rotated on different shafts than the circular blades, and the circular blades are situated at the same point in a width direction of the log as inner ends, facing a center part of the log, of the chipping head assemblies, wherein parts of the log that are to be chipped are, before chipping, partly sawn off from the log with the circular blades of the saw, wherein the chipping head assemblies are provided with head saw blades, with which, before chipping, the parts to be chipped are sawn off from the log, and wherein the saw comprises at least one inner circular blade arranged between the circular blades, with which inner circular blade the log is sawn between the sawing points of the circular blades.

8. The method according to claim 7, wherein a sawing groove or sawing grooves brought about by at least one of the inner circular blades or the circular blades of the saw are deepened after chipping or before chipping.

9. The method according to claim 7, wherein the parts to be chipped are, before chipping, sawn off from the log on only one side of the log or on opposite sides of the log.

10. The method according to claim 7, wherein the log is sawn on only one side or on opposite sides with the innermost circular blade/inner circular blades of the saw.

11. The method according to claim 7, wherein the log is milled with profiling blades arranged against the circular blades.

12. The method according to claim 7, wherein the log is guided and supported during the conveying with a guide arranged in a sawing groove of the circular blade or of the inner circular blade or with a guide supported on the surface machined by the profiling blade.

13. The apparatus according to claim 2, wherein the circular blades of the saw are arranged to saw off from the log the parts to be chipped on only one side of the log or on opposite sides of the log.

14. The apparatus according to claim 2, wherein profiling blades are arranged against the circular blades for milling a log.

15. The apparatus according to claim 3, wherein profiling blades are arranged against the circular blades for milling a log.

16. An apparatus for processing logs, which apparatus comprises:

a conveyor for conveying a log in the apparatus, a chipping canter, which comprises two chipping head assemblies for chipping the opposite sides of the log, and a saw, which comprises at least two circular blades for sawing the log on at least one side, wherein the chipping head assemblies are installed on different shafts than the circular blades, wherein the circular blades of the saw are situated before the chipping canter in the conveying direction of a log and are arranged to, before chipping, partly or completely saw off from the log the parts of the log that are to be chipped with the chipping head assemblies, and profiling blades are arranged against the circular blades for milling a log, and wherein the saw comprises at least one inner circular blade arranged between the circular blades for sawing the log between the sawing points of the circular blades.

* * * * *